US011794231B2

(12) United States Patent
Watanabe et al.

(10) Patent No.: US 11,794,231 B2
(45) Date of Patent: Oct. 24, 2023

(54) DIVIDED TOOL ATTACHMENT METHOD AND PRESS BRAKE

(71) Applicant: Amada Co., Ltd., Kanagawa (JP)

(72) Inventors: Katsumi Watanabe, Kanagawa (JP); Yousuke Onagi, Kanagawa (JP); Yuto Nishihata, Kanagawa (JP)

(73) Assignee: AMADA CO., LTD., Kanagawa (JP)

( * ) Notice: Subject to any disclaimer, the term of this patent is extended or adjusted under 35 U.S.C. 154(b) by 20 days.

(21) Appl. No.: 16/973,078

(22) PCT Filed: May 28, 2019

(86) PCT No.: PCT/JP2019/021143
§ 371 (c)(1),
(2) Date: Dec. 8, 2020

(87) PCT Pub. No.: WO2019/239883
PCT Pub. Date: Dec. 19, 2019

(65) Prior Publication Data

US 2021/0245222 A1 Aug. 12, 2021

(30) Foreign Application Priority Data

Jun. 12, 2018 (JP) ..... 2018-111731

(51) Int. Cl.
*B21D 5/02* (2006.01)

(52) U.S. Cl.
CPC ..... *B21D 5/0209* (2013.01)

(58) Field of Classification Search
CPC .... B21D 5/0209; B21D 5/002; B21D 5/0236; B21D 5/0254; B23Q 3/155;
(Continued)

(56) References Cited

U.S. PATENT DOCUMENTS 6,240,758 B1 6/2001 Nagakura
10,399,133 B2 9/2019 Felder

FOREIGN PATENT DOCUMENTS

DE 3830488 * 3/1990
EP 2946846 A1 11/2015
(Continued)

OTHER PUBLICATIONS

English translation of DE3830488A1, 21 pages, retrieved Feb. 2022. (Year: 1990).*
(Continued)

*Primary Examiner* — Adam J Eiseman
*Assistant Examiner* — Fred C Hammers
(74) *Attorney, Agent, or Firm* — Renner, Otto, Boisselle & Sklar, LLP

(57) ABSTRACT

Different divided tools are attached to tool attachment portions using automatic tool changers in proximity to slit tools that have already been attached to tool attachment portions. The attached different divided tools are moved toward the previously attached divided tools using the automatic tool changers, and the different divided tools are caused to abut on the previously attached divided tools. In a case in which a torque of a servomotor for moving the automatic tool changers in a left-right direction has reached a setting value set in advance, the different divided tools are detected to have abutted on the previously attached divided tools, and the moving of the different divided tools is stopped.

8 Claims, 4 Drawing Sheets

(58) Field of Classification Search
CPC ..... B23Q 3/15546; B23Q 3/1556; B23Q 2003/155414; B23Q 2003/155421
USPC ..... 72/389.3
See application file for complete search history.

(56) References Cited

FOREIGN PATENT DOCUMENTS

| | | | |
|---|---|---|---|
| JP | 3-53047 | B2 | 8/1991 |
| JP | 2521742 | B2 | 8/1996 |
| JP | 2591415 | B2 | 3/1997 |
| JP | 2000-071028 | A | 3/2000 |
| JP | 2000-94039 | A | 4/2000 |
| JP | 2014-091137 | A | 5/2014 |

OTHER PUBLICATIONS

International Search Report for corresponding Application No. PCT/JP2019/021143, dated Jul. 2, 2019.
Written Opinion for corresponding Application No. PCT/JP2019/021143, dated Jul. 2, 2019.
Extended European Search Report for corresponding EP Application No. 19819067.0 dated Jul. 7, 2021.

* cited by examiner

DIVIDED TOOL ATTACHMENT METHOD AND PRESS BRAKE

TECHNICAL FIELD

The present disclosure relates to a divided tool attachment method for attaching a plurality of divided tools to tool attachment portions of a press brake using an automatic tool changer (ATC) and to the press brake. More specifically, the present disclosure relates to an attachment method by which it is possible to attach a plurality of divided tools to tool attachment portions of a press brake in a mutually contact (abutting) state without causing minute gaps between divided tools when the divided tools are attached using an ATC, and to the press brake used in the attachment method.

BACKGROUND ART

In a case in which folding is performed on a plate-shaped workpiece using a press brake, an upper tool and a lower tool are attached to upper and lower tables. Also, the workpiece is supplied between the upper and lower tools, the workpiece is positioned therebetween, and the upper and lower tools are engaged, thereby folding the workpiece into a V shape. In the related art, attachment/detachment of the upper tool and the lower tool to and from the upper and lower tables and change of the upper tool and the lower tool from the upper and lower tables are performed in accordance with the lengths of folded lines of workpieces. In this case, a plurality of tools corresponding to the bending lengths of workpieces are needed. Thus, there is a problem that storage and management of the tools are burdensome.

Thus, a plurality of types of divided tools with different width dimensions are combined to address bending lengths of workpieces in recent years. In this case, attachment/detachment of divided tools to and from the tool attachment portions provided in the upper and lower tables of the press brake and change of the divided tools from the tool attachment portions are automatically performed using an automatic tool changer (ATC) (see Patent Literatures 1 and 2, for example).

CITATION LIST

Patent Literature

Patent Literature 1: Japanese Patent Laid-Open No. 2000-71028

Patent Literature 2: Japanese Patent Laid-Open No. 2014-91137

SUMMARY

Incidentally, in a case in which a plurality of divided tools are attached to tool attachment portions provided in upper and lower tables using an ATC, an operation of causing the divided tools to approach each other is performed using the ATC in order to bring each of the tools into close contact after the plurality of divided tools are disposed at temporary positions at the tool attachment portions (see description in [0061] in Patent literature 1, for example). In this case, a servomotor included in the ATC is controlled on the basis of position information of an encoder included in the servomotor to perform position control of the ATC with reference to information regarding to the positions at which the divided tools are to be positioned, length information of the combined divided tools, and the like.

Therefore, slight gaps may remain between divided tools even in a case in which the operation of causing the divided tools to approach each other to precisely position the ATC at a command position in the position control, due to backlash of a drive unit, slight deflection of fingers that support divided tools at end portions, negative drawing tolerance of the divided tools, or the like.

In other words, a minute gap may remain between divided tools, and this may cause a bending scratch, for example, even in a case in which the ATC is precisely positioned at the command position when the ATC is positioned through position control and the operation of causing the divided tools to approach each other is performed.

One or more embodiments were made in view of the aforementioned problem to retain a plurality of divided tools with no gaps between the divided tools even in a case in which a plurality of divided tools are combined.

Thus, according to a first aspect of the one or more embodiments, there is provided a divided tool attachment method for attaching a plurality of divided tools to tool attachment portions of a press brake using automatic tool changers (ATCs), the divided tool attachment method including: (a) attaching different divided tools to the tool attachment portions using the ATCs in proximity to previously attached divided tools already attached to the tool attachment portions; (b) relatively moving the attached different divided tools toward the previously attached divided tools using the ATCs and causing the different divided tools to abut on the previously attached divided tools; and (c) detecting that the different divided tools have abutted on the previously attached divided tools in a case in which a torque of a servomotor for moving the ATCs in a left-right direction has reached a setting value set in advance and stopping the movement of the different divided tools.

According to a second aspect of the one or more embodiments, there is provided a divided tool attachment method for attaching a plurality of divided tools to tool attachment portions of a press brake using ATCs, the divided tool attachment method including: (a) attaching the plurality of divided tools to the tool attachment portions using the ATCs; (b) pressing a divided tool on one end side in a left-right direction to the other end side using the ATCs and causing the divided tools to abut on each other after attaching the plurality of divided tools to the tool attachment portions; and (c) detecting that the divided tools has abutted on each other in a case in which a torque of a servomotor for moving the ATCs in the left-right direction has reached a setting value set in advance and stopping the pressing of the divided tool on the one end side toward the other side performed by the ATCs.

Also, according to a third aspect of the one or more embodiments, there is provided a press brake including: upper and lower tables including tool attachment portions for attaching divided tools; upper and lower ATCs capable of relatively reciprocating between tool storage portions and the upper and lower tool attachment portions in order to change detachable divided tools from the upper and lower tool attachment portions; a torque detecting unit configured to detect a torque of a servomotor for moving the ATCs has reached a setting value set in advance when the ATCs are moved in a left-right direction along the tool attachment portions; and a control device configured to compare the setting value set in advance with a detection value detected by the torque detecting unit and stop the movement of the ATCs when the detection value is equal to the setting value.

According to the one or more embodiments, whether or not the divided tools have abutted on each other is detected by detecting the torque of the servomotor for moving the automatic tool changers. It is thus possible to retain the plurality of divided tools with gaps eliminated between the divided tools attached to the tool attachment portions.

DESCRIPTION OF EMBODIMENTS

Hereinafter, a press brake according to an embodiment of the present invention will be described using drawings. Incidentally, a configuration of a press brake in which upper and lower divided tools are automatically changed using automatic tool changers (ATC) is known as described in Patent Literatures 1 and 2, for example. Therefore, an overall configuration of the press brake will be schematically described for easiness of understanding.

Figure 1:
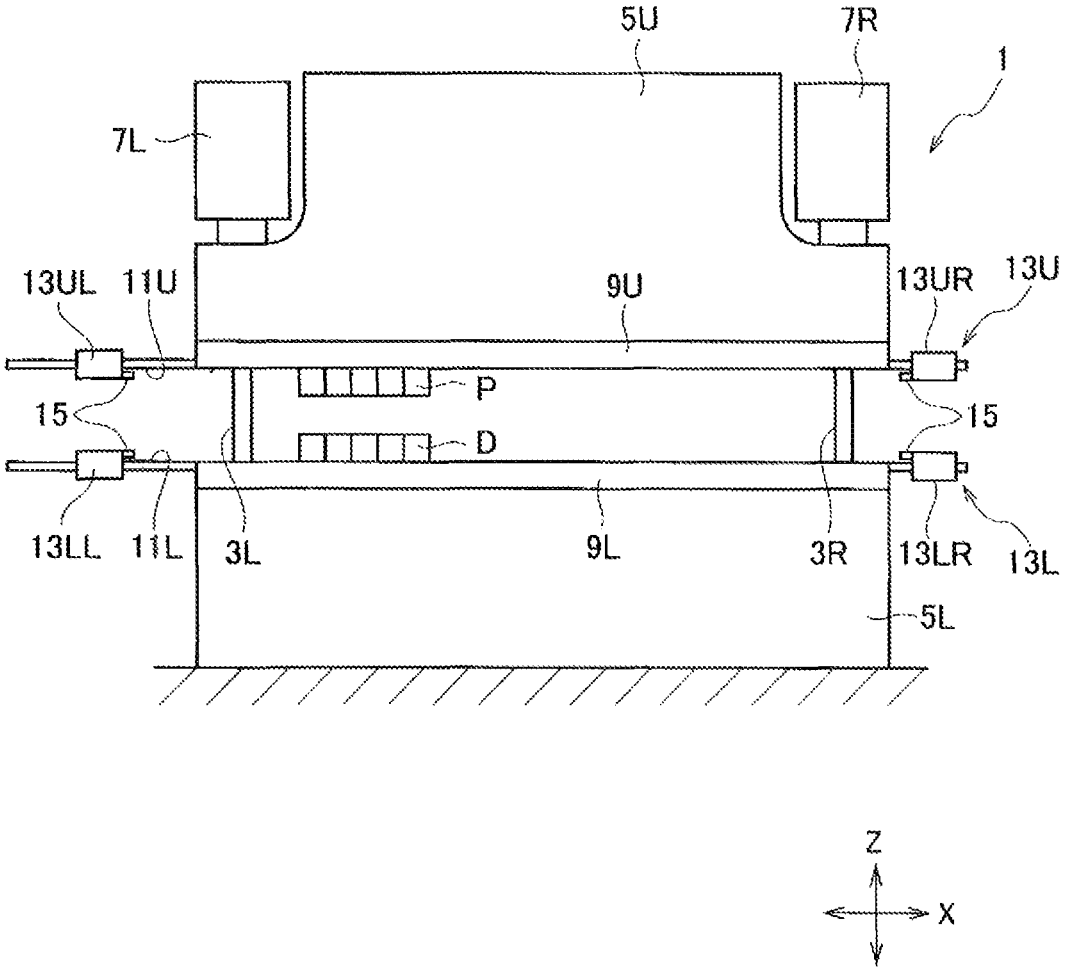
FIG. 1 is an explanatory front view conceptually and schematically illustrating a configuration of a press brake according to an embodiment of the present invention.

Referring to FIG. 1, a press brake 1 according to the embodiment of the present invention includes left and right side frames 3L and 3R. An upper table 5U is included above the side frames 3L and 3R. Also, a lower table 5L that faces the upper table 5U in an up-down direction (a Z-axis direction) is included below the side frames 3L and 3R. The upper table 5U is configured as a ram moved up and down by upper and lower operating devices 7L and 7R such as fluid pressure cylinders, for example, attached to the side frames 3L and 3R.

Tool attachment portions 9U and 9L in a left-right direction (X-axis direction) to which upper and lower tools (divided tools) P and D are attached are included in the upper and lower tables 5U and 5L. Also, guide members 11U and 11L in the left-right direction are included behind the upper and lower tables 5U and 5L (behind the upper and lower tables 5U and 5L in the Y-axis direction). Upper and lower automatic tool changers (ATCs) 13U and 13L for changing the tools P and D between tool storage portions (not illustrated in FIG. 1) and the tool attachment portions 9U and 9L are included in the upper and lower guide members 11U and 11L.

A pair of left and right ATC 13UL and 13UR and a pair of left and right ATC 13LL and 13LR are included in the upper and lower ATCs 13U and 13L, respectively, so as to be freely movable in the left-right direction along the upper and lower guide members 11U and 11L. Each of the ATCs 13UL, 13UR, 13LL, and 13LR can individually move and be positioned in the left-right direction by controlling a servomotor (not illustrated) individually provided for each of the ATCs 13UL, 13UR, 13LL, and 13LR under control of a control device (not illustrated). The configuration of the ATCs 13UL, 13UR, 13LL, and 13LR is known as described in WO00/41824, for example.

Figure 2:
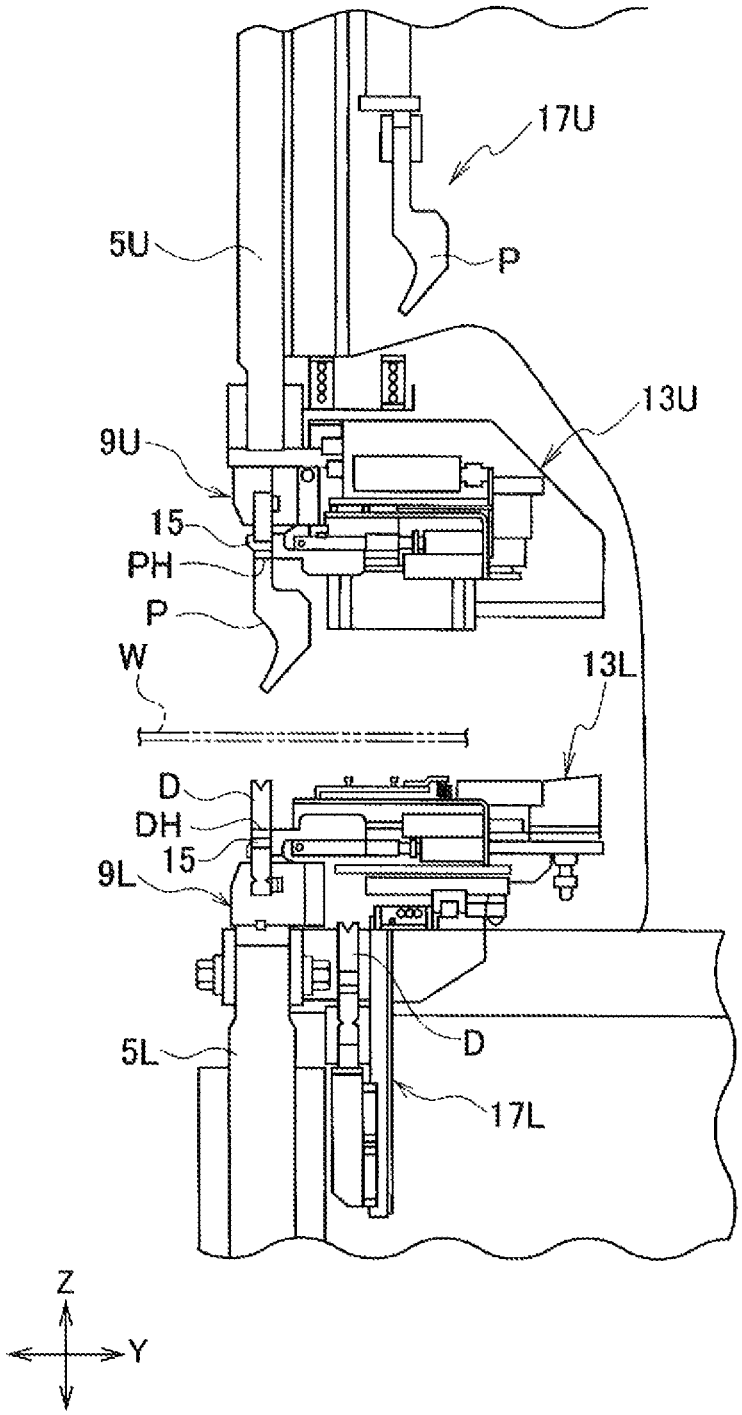
FIG. 2 is an explanatory side sectional view of the press brake.

Therefore, detailed description of the configuration of each ATC will be omitted. Note that tool retention members (fingers) 15 that are engageable with engagement holes PH and DH (see FIG. 2) in the front-back direction included in the tools P and D, respectively, are included in each of the ATCs 13UL, 13UR, 13LL, and 13LR.

The tool retention members 15 are included to be movable (to be able to advance and retreat) in the front-back direction (the Y-axis direction; the left-right direction in FIG. 2) in order to engage with the engagement holes PH and DH included in the tools P and D, respectively, or in order to be separated from the engagement holes PH and DH included in the tools P and D, respectively. Therefore, if the tool retention members 15 are retained in an advancing state in which the tool retention members 15 retain the tools P and D and are moved in the left-right direction, then the tool retention members 15 abut on the upper and lower tools P and D attached to the tool attachment portions 9U and 9L in the left-right direction.

The upper and lower ATCs 13U and 13L are adapted to attach/detach the upper and lower tools P and D to and from the upper and lower tool attachment portions 9U and 9L and change the upper and lower tools P and D from the upper and lower tool attachment portions 9U and 9L, and the tool retention members 15 are included so as to be engageable with the engagement holes PH an DH in the front-back direction included in the upper and lower tools P and D. The tool retention members 15 are included so as to be able to advance and retreat with respect to the tools P and D attached to the tool attachment portions 9U and 9L as is well known. Also, the tool retention members 15 are retained in a state in which the tool retention members 15 have advanced in a horizontal state when the tool retention members 15 are inserted into the engagement holes PH and DH included in the upper and lower tools P and D, respectively, attached to the tool attachment portions 9U and 9L to hold the tools P and D.

Note that the operation of the ATCs 13U and 13L moving in the left-right direction, the operation of attaching and detaching the tools to and from the tool attachment portions 9U and 9L, and the operation of changing the tools P and D between the tool attachment portions 9U and 9L and tool storage portions 17U and 17L have already been well-known, as described in Patent Literature 1, for example. Therefore, detailed description of the operations of the ATCs will be omitted.

Figure 3:
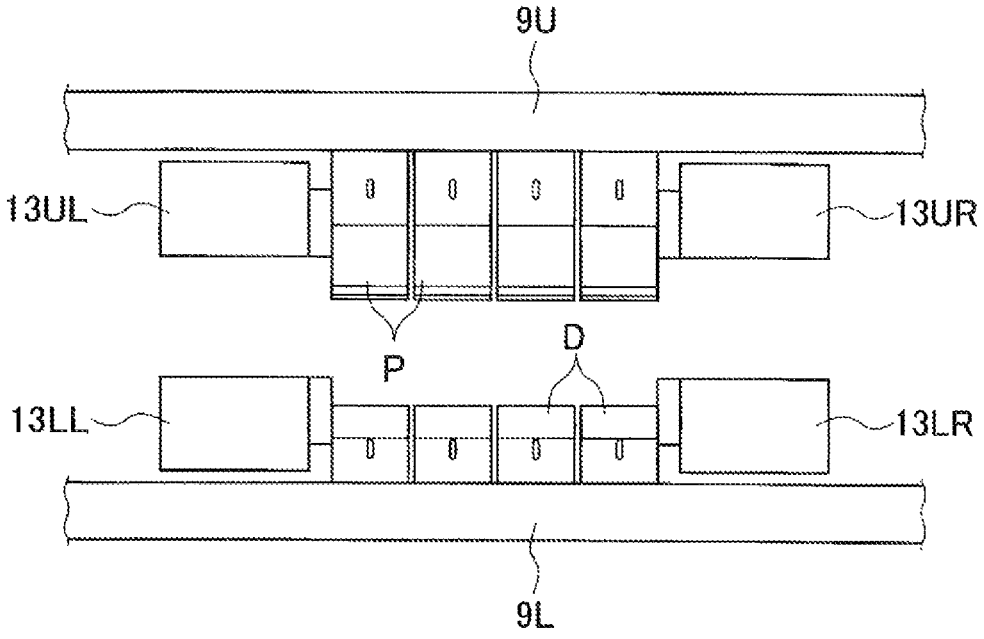
FIG. 3 is an explanatory diagram of a method in the related art.

Incidentally, in a case in which the upper and lower tools P and D are attached to the upper and lower tool attachment portions 9U and 9L using the upper and lower ATCs 13UL, 13UR, 13LL, and 13LR, the attachment is performed as follows. Position control for the upper and lower ATCs 13UL, 13UR, 13LL, and 13LR is performed under control of the control device to arrange the upper and lower tools P and D at desired positions, as conceptually illustrated in FIG. 3. In this case, slight gaps may be generated between the tools P and D as illustrated in FIG. 3 due to backlash of the drive unit, deflection of the tool retention members 15, negative drawing tolerance of the tools P and D, and the like.

For example, there is a case in which with respect to the ATCs 13UL and 13LL on one side, an operation of causing the ATCs 13UR and 13LR on the other side to move to and approach the ATCs 13UL and 13LL on the one side is performed. The operation of causing the ATCs 13UR and 13LR on the other side to approach the ATCs 13UL and 13LL on the one side is performed through position control for positioning the ATCs 13UR and 13LR on the other side under control of the control device. Therefore, slight gaps may remain between the tools P and D even in a case in which the ATCs 13UR and 13LR are positioned at precise positions through the position control. In other words, there is a case in which adjacent tools P and D do not abut on (contact with) each other.

Figure 4:
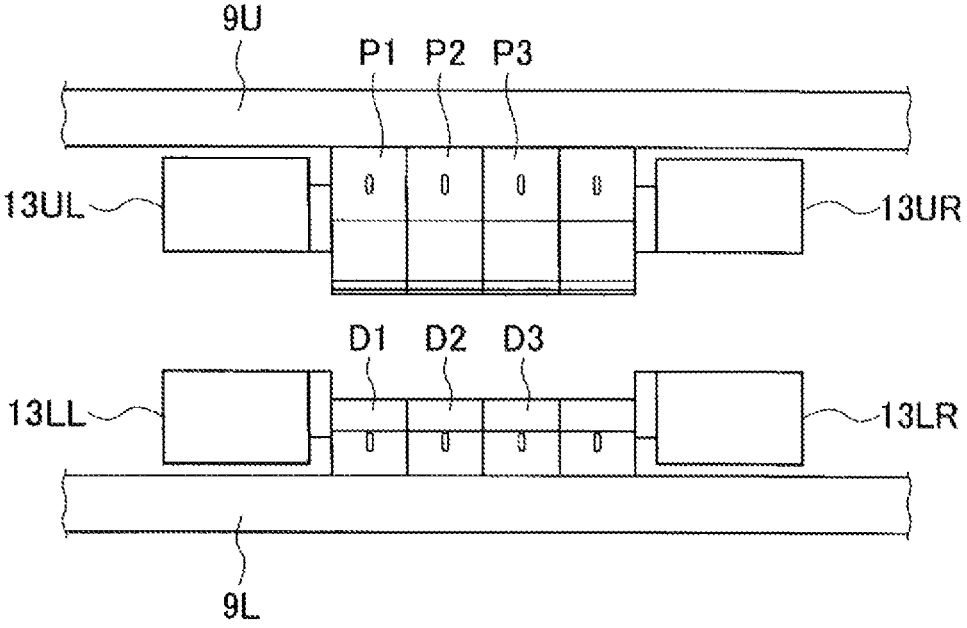
FIG. 4 is an explanatory diagram of a method according to the embodiment.

Thus, according to the embodiment, tools P1 and D1 on one end side among the tools P and D are positioned at predetermined positions (reference positions) as illustrated in FIG. 4. Then, secured states of the tools P1 and D1 are retained in a non-movable state by pressing and securing piece (not illustrated; illustrated with the reference sign 31 in Patent Literature 1) included in the tool attachment portions 9U and 9L or the ATCs 13UL and 13LL on the one side. Then, different tools P2, D2, P3, D3, . . . are tentatively (temporarily) attached to the tool attachment portions 9U and 9L in a movable state in proximity to the tools P1 and D1 that have already been attached, using the ATCs 13UR and 13LR. Thereafter, the tools P2, P3, . . . , D2, D3, . . . are relatively pressed and moved toward the ATCs 13UL and 13LL using the ATCs 13UR and 13LR.

At this time, a control device 21 that controls the operation of the ATCs 13UR and 13LR pressing the tools P2, P3, . . . , D2, D3, . . . is configured as follows.

Figure 5:
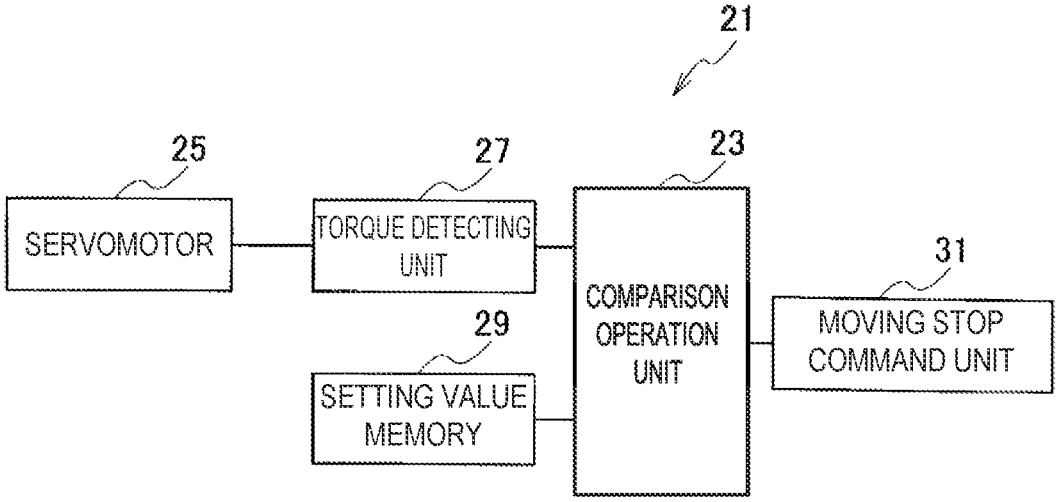
FIG. 5 is a functional block diagram.

The control device 21 is configured of a computer, for example, and includes a comparison operation unit 23 as illustrated in FIG. 5. A torque detecting unit 27 included in each servomotor 25 for moving the ATCs 13UR and 13LR and the like is connected to the comparison operation unit 23. Further, a setting value memory 29 is connected to the comparison operation unit 23. The setting value memory 29 stores a torque setting value set in advance.

Then, a detected torque detected by the torque detecting unit 27 and the torque setting value stored in the setting value memory 29 are compared by the comparison operation unit 23. If the detected torque is equal to the set torque as a result of the comparison, a moving stop command unit 31 connected to the comparison operation unit 23 outputs a stop command signal to the servomotor 25, and the moving of the servomotor 25 is then stopped.

In other words, the pressing by the ATCs 13UR and 13LR is stopped when a pressing force with which the ATCs 13UR and 13LR press the tools P2, P3, . . . , D2, D3, . . . reaches the setting value set in advance.

As already understood, the control device 21 that controls the operations of the press brake 1 includes the setting value memory 29 that stores the torque set in advance and the comparison operation unit 23 that compares a detected torque value with the setting value.

Therefore, each of the tools P and D is pressed with a pressing force (torque) set in advance, and the adjacent tools P1, P2, . . . , D1, D2, . . . abut on (contact with) each other. Thus, no gaps are present between the tools P1, P2, . . . , D1, D2, . . . as illustrated in FIG. 4.

As already understood, the tools P1 and D1 on one end side are positioned at precise positions in advance through positioning control. Then, the tools P2, P3, . . . , D2, D3, . . . are pressed with a predetermined pressing force set in advance such that the different tools P2, P3, . . . , D2, D3, . . . that have tentatively been attached are caused to abut on the tools P1 and D1 in a positioned state. Therefore, the adjacent tools P1, P2, . . . , D1, D2, . . . are arranged in a state in which the adjacent tools P1, P2, . . . , D1, D2, . . . are in contact with each other. It is thus possible to solve the problem that minute gaps are present between the tools P1, P2, P3, . . . , D1, D2, D3, . . . . Note that when the different tools P2 and D2 are caused to abut on the tools P1 and D1, the tools P1 and D1 are secured in a non-movable state by the ATCs 13UL and 13LL on the one side, for example.

Incidentally, as a method for tentatively attaching the plurality of tools P and D to the tool attachment portions 9U and 9L of the press brake using the ATCs 13U and 13L and causing the adjacent tools P and D to abut on (contact with) each other, the following methods are also exemplified. In detail, (A) every time the different tools P and D are tentatively attached to the tool attachment portions 9U and 9L one by one using the ATCs 13U and 13L, or every time a predetermined number of different tools P and D are tentatively attached, the different tools P and D are pressed and moved toward the tools P1 and D1 that have already been attached and are caused to abut on the tools P1 and D1.

Also, (B) a plurality of desired tools P2, P3, . . . , D2, D3, . . . are tentatively attached to the tool attachment portions 9U and 9L using the ATCs 13U and 13L. Then, the plurality of tools P2, P3, . . . , D2, D3, . . . are collectively moved toward the tools P1 and D1 that have already been attached. Then, the adjacent tools P and D are caused to abut on each other.

Also, (C) a plurality of desired tools P and D are tentatively attached to the tool attachment portions 9U and 9L using the ATCs 13UR and 13LR. Then, an operation of collectively moving the plurality of tools P and D toward the tools P1 and D1 that have already been attached and causing the tools P and D to abut on each other is repeated a plurality of times. In other words, it is possible to cause the adjacent tools P and D to abut on each other by grouping a plurality of desired tools P and D and pressing the tools P and D in each group toward the tools P1 and D1 every time the tools P and D in each group are attached to the tool attachment portions 9U and 9L using the ATCs 13U and 13L.

In other words, there are various methods for tentatively attaching a plurality of tools P and D to the tool attachment portions 9U and 9L and attaching the tools P and D in a mutually contact (abutting) state.

The present invention is not limited to the one or more embodiments described above, and various modifications can be made without departing from the gist of the present invention.

The disclosure of the present application relates to a subject matter described in Japanese Patent Application No. 2018-111731 filed on Jun. 12, 2018, entire of which is incorporated herein by reference.

The invention claimed is:

1. A divided tool attachment method for attaching a plurality of divided tools to tool attachment portions of a press brake using first automatic tool changers and second automatic tool changers, the divided tool attachment method comprising:

(a) attaching different divided tools to the tool attachment portions using the first and second automatic tool changers, the first and second automatic tool changers being configured to attach and detach the different divided tools respectively to and from the tool attachment portions, in proximity to previously attached divided tools already attached to the tool attachment portions;

(b) relatively moving the attached different divided tools toward the previously attached divided tools using the first automatic tool changers by moving the first automatic tool changers with a servomotor in a left-right direction, and causing the different divided tools to be pressed on the previously attached divided tools while the previously attached divided tools are secured in a non-movable state by the second automatic tool changers; and (c) detecting that the different divided tools have been pressed on the previously attached divided tools in a case in which a torque of the servomotor has reached a setting value set in advance and stopping the movement of the different divided tools.

2. A divided tool attachment method for attaching a plurality of divided tools to tool attachment portions of a press brake using first automatic tool changers and second automatic tool changers, the divided tool attachment method comprising:

(a) attaching the plurality of divided tools to the tool attachment portions along a left-right direction by using the first and second automatic tool changers, the first and second automatic tool changers being configured to attach and detach the different divided tools respectively to and from the tool attachment portions;

(b) pressing a divided tool on a first end of the plurality of divided tools in the left-right direction toward a divided tool on a second end of the plurality of divided tools in the left-right direction using the first automatic tool changers by moving the first automatic tool changers with a servomotor in the left-right direction, and causing the plurality of divided tools to be pressed on each other after attaching the plurality of divided tools to the tool attachment portions and while the divided tool on the second end of the plurality of divided tools is being secured in a non-movable state by the second automatic tool changers; and (c) detecting that the plurality of divided tools have been pressed on each other in a case in which a torque of a servomotor has reached a setting value set in advance and stopping the pressing of the divided tool on the first side of the plurality of divided tools toward the second side of the plurality of divided tools performed by the first automatic tool changers.

3. A press brake comprising:

upper and lower tables including tool attachment portions for attaching divided tools;

first automatic tool changers and second automatic tool changers capable of relatively reciprocating between tool storage portions and the tool attachment portions in order to change detachable divided tools from the tool attachment portions, the first and second automatic tool changers configured to attach different divided tools to the tool attachment portions in proximity to previously attached divided tools already attached to the tool attachment portions;

a torque detecting unit configured to detect a torque of a servomotor, the servomotor configured to move the first automatic tool changers; and a control device configured to:

control the second automatic tool changers to secure the previously attached divided tools in a non-movable state;

control the first automatic tool changers to press the different divided tools on the previously attached divided tools by relatively moving the attached different divided tools toward the previously attached divided tools while the previously attached divided tools are being secured in the non-movable state by the second automatic tool changers;

compare a setting value set in advance with a detection value detected by the torque detecting unit when the different divided tools are pressed on the previously attached divided tools; and stop the movement of the first automatic tool changers when the detection value is equal to the setting value.

4. A press brake comprising:

upper and lower tables including tool attachment portions for attaching divided tools;

first automatic tool changers and second automatic tool changers capable of relatively reciprocating between tool storage portions and the tool attachment portions in order to change detachable divided tools from the tool attachment portions, the first and second automatic tool changers configured to attach a plurality of divided tools to the tool attachment portions along a left-right direction;

a torque detecting unit configured to detect a torque of a servomotor, the servomotor configured to move the first automatic tool changers; and a control device configured to:

control the first automatic tool changers and the second automatic tool changers to attach the plurality of divided tools, the plurality of divided tools including a divided tool on a first end of the plurality of divided tools in the left-right direction and a divided tool on a second end of the plurality of divided tools in the left-right direction, to the tool attachment portion;

control the second automatic tool changers to secure the divided tool on the second end of the plurality of divided tools in a non-movable state;

control the first automatic tool changers to press the plurality of divided tools on each other by pressing the divided tool on the first end of the plurality of divided tools toward the divided tool on the second end of the plurality of divided tools while the divided tool on the second end of the plurality of divided tools is being held in the non-movable state by the second automatic tool changers;

compare a setting value set in advance with a detection value detected by the torque detecting unit when the plurality of divided tools are pressed on each other; and stop the movement of the first automatic tool changers when the detection value is equal to the setting value.

5. The divided tool attachment method according to claim 1, wherein the first and second automatic tool changers include top first and second automatic tool changers provided on an upper table of the press brake, and bottom first and second automatic tool changers provided on a lower table of the press brake.

6. A divided tool attachment method according to claim 2, wherein the first and second automatic tool changers include top first and second automatic tool changers provided on an upper table of the press brake, and bottom first and second automatic tool changers provided on a lower table of the press brake.

7. The press brake according to claim 3, wherein the first and second automatic tool changers include top first and second automatic tool changers provided on the upper table of the press brake, and bottom first and second automatic tool changers provided on the lower table of the press brake.

8. The press brake according to claim 4, wherein the first and second automatic tool changers include top first and second automatic tool changers provided on the upper table of the press brake, and bottom first and second automatic tool changers provided on the lower table of the press brake.

* * * * *